United States Patent [19]

Lenny

[11] Patent Number: 4,790,447

[45] Date of Patent: Dec. 13, 1988

[54] MODIFICATION TO FLOATING ROOF TANK DESIGN

[75] Inventor: Leslie M. Lenny, Caringbah, Australia

[73] Assignee: Caltex Oil (Australia) Pty. Limited, New South Wales, Australia

[21] Appl. No.: 910,298

[22] Filed: Sep. 17, 1986

Related U.S. Application Data

[63] Continuation of Ser. No. 723,008, Apr. 16, 1985, abandoned, which is a continuation of Ser. No. 531,506, Sep. 12, 1983, abandoned.

[30] Foreign Application Priority Data

Sep. 13, 1982 [AU] Australia ..... PF5853

[51] Int. Cl.[4] ..... B65D 88/34; B65D 88/40; B65D 88/54

[52] U.S. Cl. ..... 220/220; 137/1; 137/172; 137/264; 137/561 R; 210/172; 210/532.1; 210/DIG. 9; 220/216

[58] Field of Search ..... 220/216–227, 220/82 R; 210/521, 522, 522.1, 533, 536, 172, DIG. 9; 137/1, 574, 561 R, 264; 222/62, 67

[56] References Cited

U.S. PATENT DOCUMENTS

| | | | |
|---|---|---|---|
| 326,580 | 9/1885 | Minor et al. . | |
| 1,113,683 | 10/1914 | Pfahler . | |
| 1,135,900 | 4/1915 | Hughson . | |
| 1,232,370 | 7/1917 | Morison . | |
| 1,254,058 | 1/1918 | Morgan . | |
| 1,314,140 | 8/1919 | Jacobus . | |
| 1,406,950 | 2/1922 | Fackert . | |
| 1,457,065 | 5/1923 | Johnson . | |
| 1,530,077 | 3/1925 | Haynes . | |
| 1,548,400 | 8/1925 | Walker . | |
| 1,592,244 | 7/1926 | Wiggins | 220/219 |
| 1,714,338 | 5/1929 | Yelmgren . | |
| 1,734,622 | 11/1929 | Griffin | 220/216 |
| 1,768,209 | 6/1930 | Miller . | |
| 1,829,732 | 11/1931 | Allen . | |
| 1,831,898 | 11/1931 | Wignall | 137/172 X |
| 1,906,834 | 5/1923 | Beckwith | 222/62 |
| 2,002,407 | 5/1935 | Lemke | 210/533 |
| 2,008,686 | 7/1935 | Day | 210/DIG. 9 |
| 2,237,461 | 4/1941 | Tokheim | 220/221 |
| 2,287,212 | 6/1942 | Wiggins | 220/220 |
| 2,321,058 | 6/1943 | Wiggins | 220/219 |
| 2,329,967 | 9/1943 | Wiggins | 220/220 |
| 2,375,282 | 5/1945 | Clemens . | |
| 2,422,869 | 6/1947 | Wiggins . | |
| 2,439,792 | 4/1948 | Boardman | 220/217 |
| 2,460,258 | 1/1949 | Jones | 137/172 X |
| 2,493,166 | 1/1950 | Schmitz, Jr. . | |
| 2,715,465 | 8/1955 | Wood | 210/533 X |
| 2,772,805 | 12/1956 | Grundis | 220/220 |
| 2,789,722 | 4/1957 | Oberst | 220/219 |
| 2,825,422 | 3/1958 | Schoenfeld . | |
| 2,896,657 | 7/1959 | Uhll et al. | 210/533 X |
| 2,917,924 | 12/1959 | Messick | 220/82 R |
| 2,924,350 | 2/1960 | Greer | 220/216 X |
| 2,947,437 | 8/1960 | Greer | 220/216 X |
| 3,206,031 | 9/1965 | Messa . | |

(List continued on next page.)

FOREIGN PATENT DOCUMENTS

| | | | |
|---|---|---|---|
| 317084 | 8/1974 | Austria . | |
| 805512 | 3/1951 | Fed. Rep. of Germany . | |
| 1029768 | 5/1958 | Fed. Rep. of Germany | 220/216 |
| 1209085 | 2/1960 | France | 220/216 |
| 2071748 | 1/1981 | United Kingdom . | |

*Primary Examiner*—Allan N. Shoap
*Attorney, Agent, or Firm*—Oblon, Fisher, Spivak, McClelland & Maier

[57] ABSTRACT

A floating roof liquid storage tank, having a tank shell which is supported on a fixed base, and a floating roof supported by the liquid stored in the tank. Included in the base or roof is a displacement device to substantially displace the stored liquid when the floating roof is in its lowest position. In this way the volume of the heel of liquid unable to be removed from the tank is reduced. The displacement device can take the form of a container which protrudes downwardly from the roof, or a layer of ballast on the base of the tank. The ballast layer can be a liquid heavier than the stored liquid which can be retained in a dam if desired.

12 Claims, 15 Drawing Sheets

U.S. PATENT DOCUMENTS

| | | | |
|---|---|---|---|
| 3,241,704 | 3/1966 | Marriott et al. | 220/216 X |
| 3,438,215 | 4/1969 | Frijlink | 220/222 X |
| 3,529,728 | 9/1970 | Middelbeek et al. . | |
| 3,535,236 | 10/1970 | Travis | 220/216 |
| 3,592,009 | 7/1971 | Glijnis et al. . | |
| 3,680,729 | 8/1972 | Bonavent et al. | 220/216 X |
| 3,744,643 | 7/1973 | Tsunoda . | |
| 3,964,873 | 6/1974 | Aramaki et al. . | |
| 4,138,342 | 2/1979 | Middelbeek et al. . | |
| 4,170,877 | 10/1979 | Pickering . | |
| 4,230,138 | 10/1980 | Tanaka | 220/217 X |
| 4,244,487 | 1/1981 | Kern | 220/216 |
| 4,431,536 | 2/1984 | Thompson | 220/219 X |
| 4,537,211 | 8/1985 | Almeida . | |

MODIFICATION TO FLOATING ROOF TANK DESIGN

This application is a continuation of application Ser. No. 723,008 filed Apr. 16, 1985 which is a continuation of Ser. No. 531,506 filed on Sept. 12, 1983, both now abandoned.

BACKGROUND OF THE INVENTION

1. Field of the Invention

The present invention relates to floating roof liquid storage tanks of the type that are extensively used to store liquid hydrocarbon products such as crude oil, gasoline, and the like.

2. Description of the Prior Art

Oil refineries and storage terminals utilize floating roof tanks for the storage of hydrocarbon stocks which have a higher vapour pressure than products which can be stored in cone roof tanks. Typical of such products are gasoline, naphthas and crude oil.

The filling and emptying cycle of such tanks is between a normal minimum to a normal maximum gauge (or depth) which typically is approximately 2 meters to approximately 14 meters respectively. The minimum gauge elevation is determined by the need to keep the underside of the roof clear of any projections into the tank (e.g. tank heaters, mixers, suction/rundown lines) and the requirement to provide sufficient head for pumping equipment connected to the tank. As all working movements in the tank are above the minimum gauge, the volume in the tank at minimum gauge, (or heel) is a static inventory which represents a high cost.

Typically a floating roof tank is at least approximately 20 meters in diameter. Thus a cylindrical heel 30 meters in diameter and 2 meters thick contains many barrels of valuable liquid. This liquid must be purchased but cannot be sold as it cannot be extracted from the tank whilst the tank remains in use.

It is known from U.S. Pat. Nos. 2,924,350; 2,947,437 and 3,167,203 to have a water/stored liquid interface which utilizes the fact that most hydrocarbons will float on water. However the arrangements of those patents are not directed to reducing heel inventory, and suffer from the severe disadvantage that maintanence of the tank wall, because of corrosion, must be carried out under water.

SUMMARY OF THE INVENTION

It is an object of the present invention to provide an improved liquid storage tank which will permit much smaller volumes of product in the tank at minimum gauge and thereby reduce both the volume and cost of the static inventory.

According to one aspect of the present invention, there is disclosed a floating roof liquid storage tank comprising a tank shell supported by a fixed base; a floating roof bouyantly supported by liquid in said tank, said roof including projections extending downwardly therefrom to support said roof at a minimum liquid level in said tank by engagement of the lowermost portions of said projections with said base, said projections having a substantially negligible volume relative to the volume of said tank; and displacement means located within said tank between said base and roof, characterized in that said displacement means includes a substantially rigid structure and has a substantially constant volume in use which substantially fills the volume between said base and roof when said roof is at the minimum level. The rigid structure is preferably located on the base, or is attached to, and movable with, the underside of the roof.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
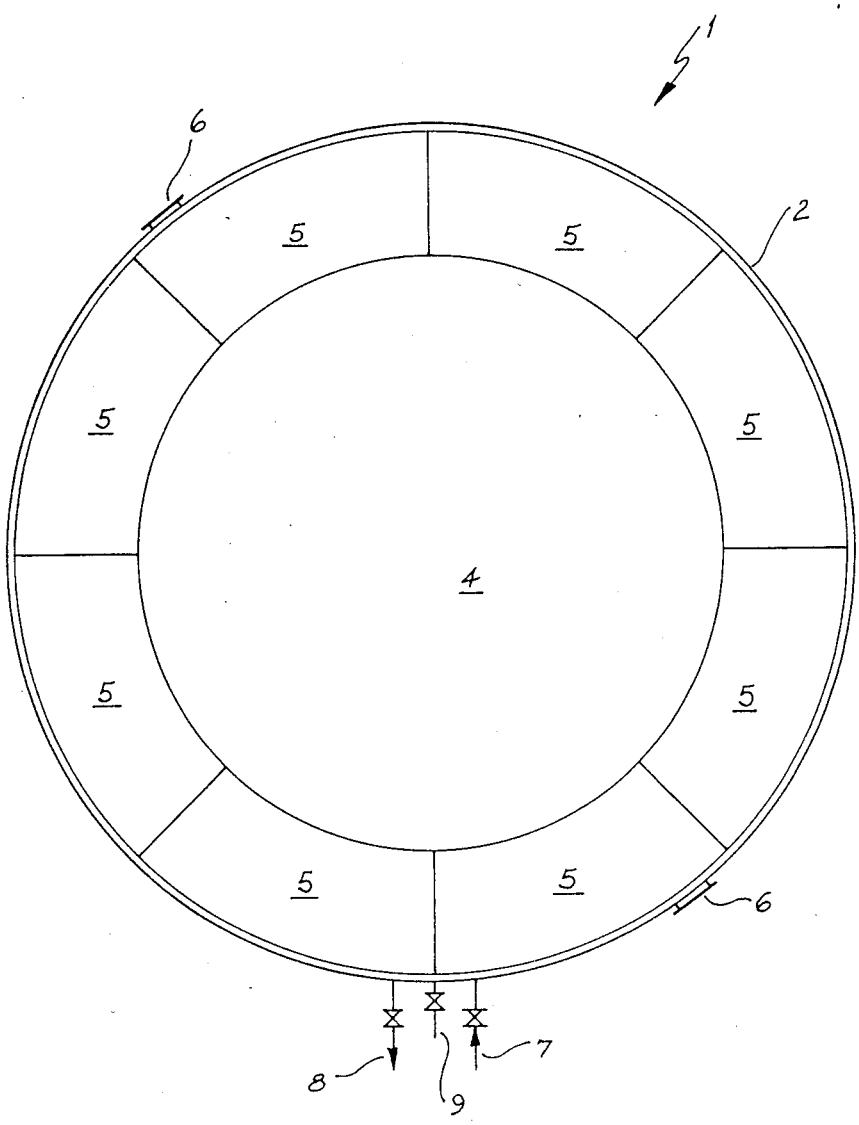
FIG. 1 is a plan view of a conventional floating roof tank.
Figure 2:
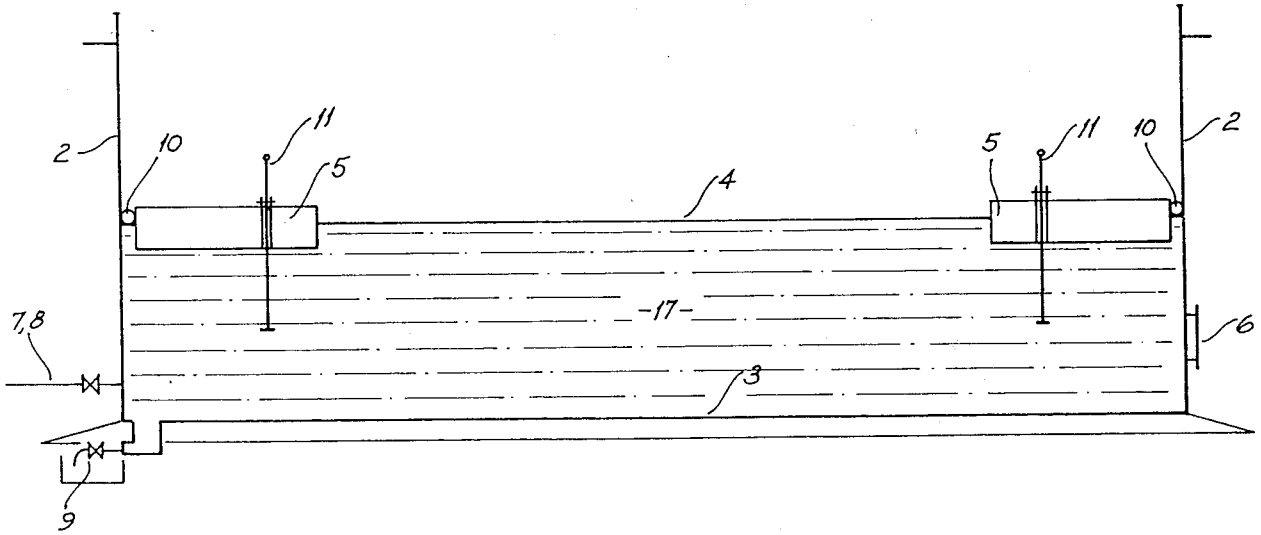
FIG. 2 is a vertical cross-sectional of the tank of FIG. 1.

As illustrated in FIGS. 1 and 2, a conventional floating roof tank 1 comprises a tank shell 2, a base or tank floor 3, and a tank roof 4 floating on pontoons 5. As is standard on most tanks, there are manways 6, an inlet line 7 and an outlet line 8 and a drain 9, as well as projections or roof legs 11 which are conventional and which prevent the roof 4 from contacting the base 3. The tank roof 4 floats on volatile liquid product 17 and rises and falls with the level of the liquid product 17. Seals 10 are provided around the circumference of the roof 4 to provide a seal with the tank shell 2.

Figure 3:
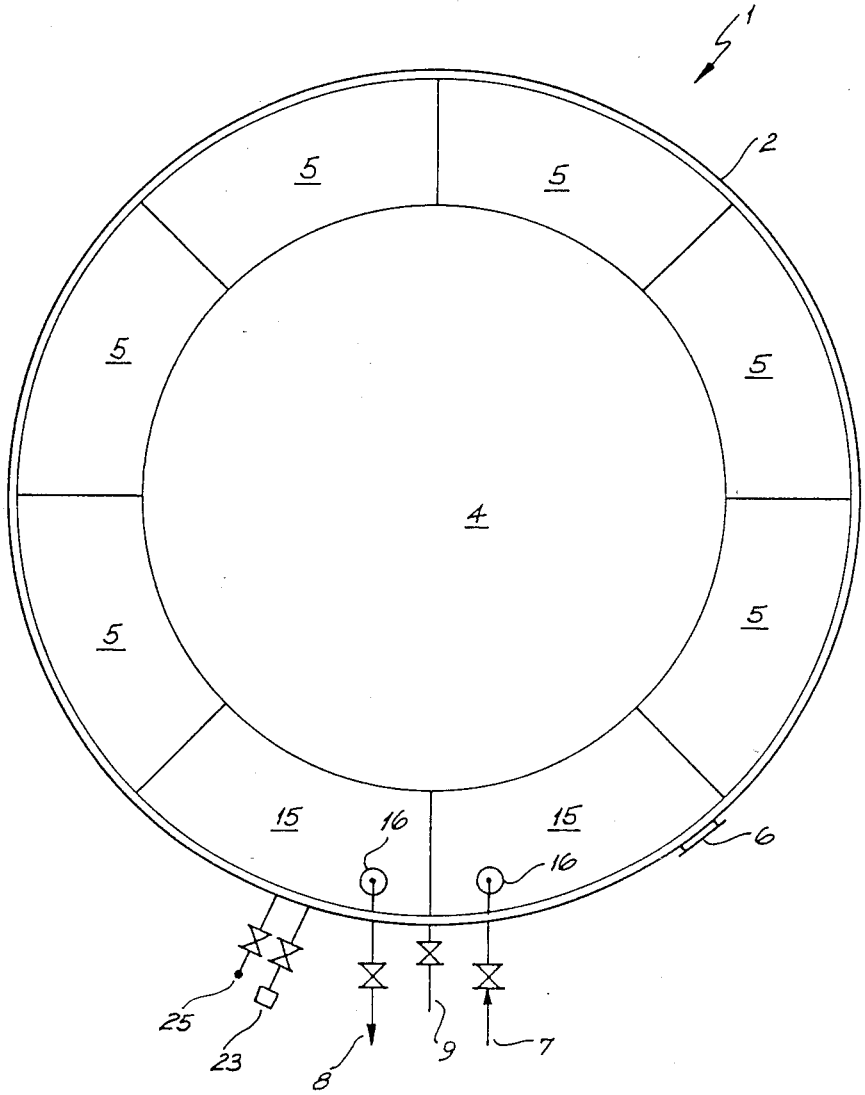
FIG. 3 is a plan view of a floating roof tank of a first embodiment of the present invention.
Figure 4:
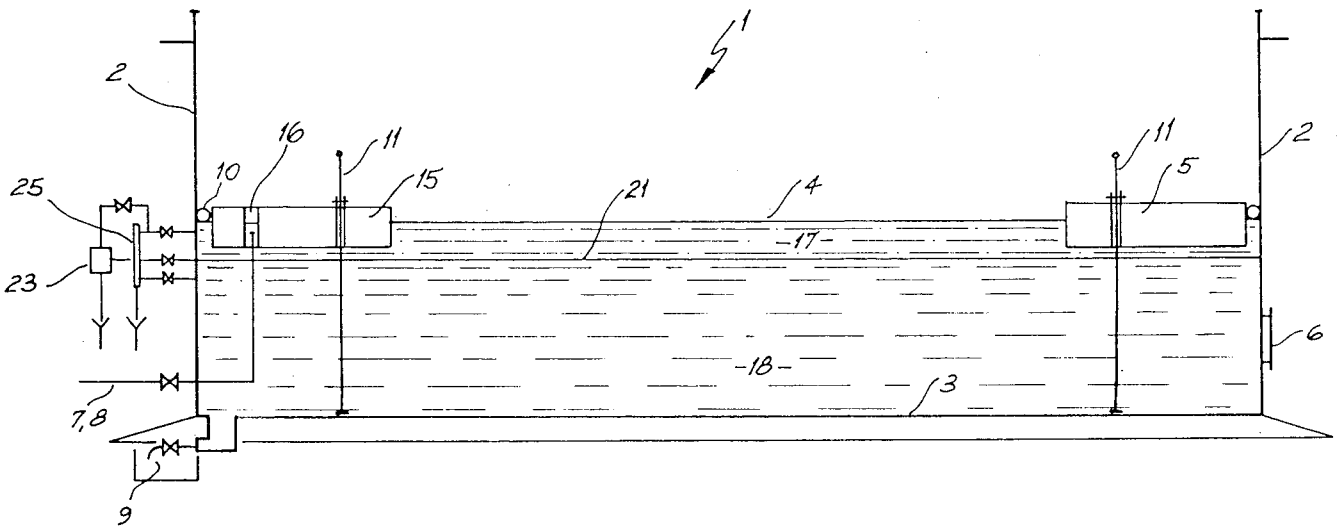
FIG. 4 is a vertical cross-sectional of the tank of FIG. 3.
Figure 5:
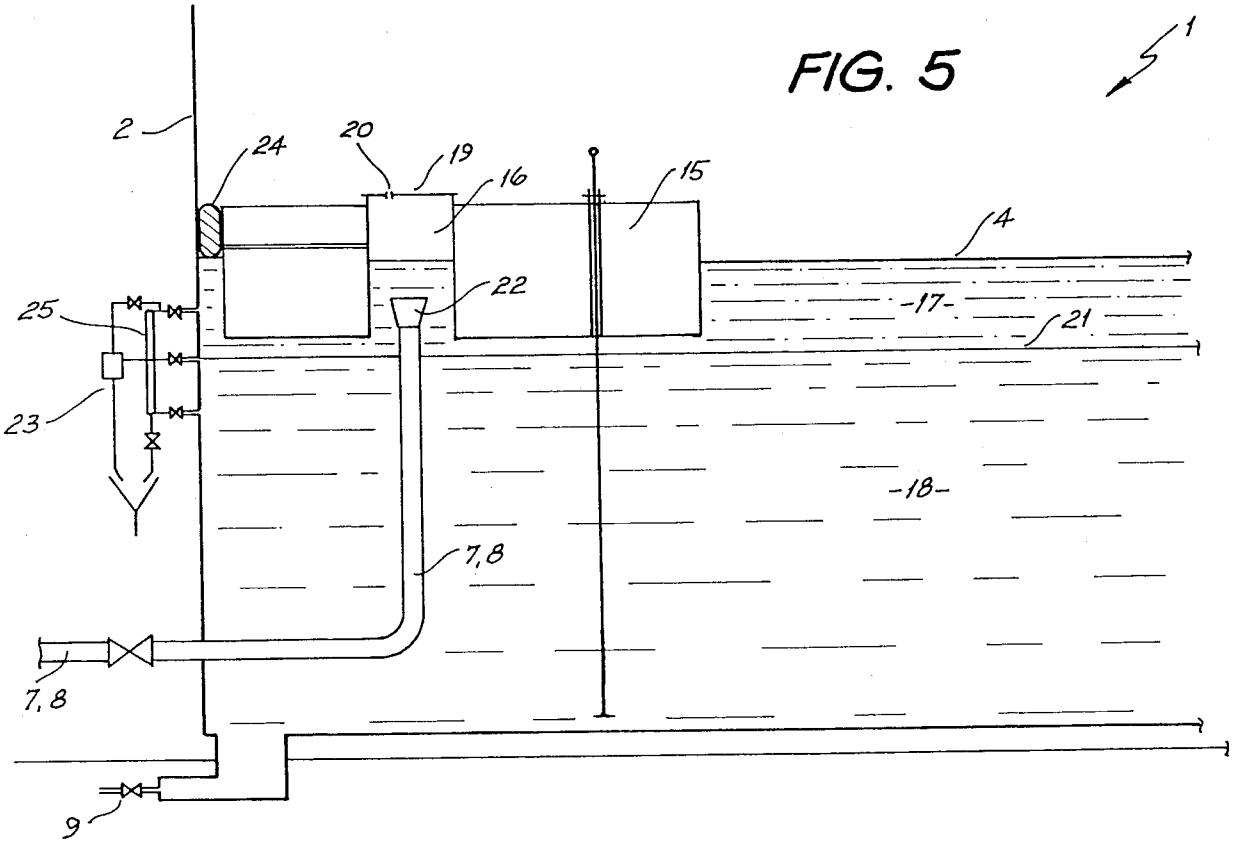
FIG. 5 is a detailed view of a portion of FIG. 4.

A first embodiment of the present invention is illustrated in FIGS. 3 to 5, and the tank 1 basically comprises the same components as the tank illustrated in FIGS. 1 and 2, but with modifications.

As is illustrated in FIGS. 3 and 4, a modified pontoon 15 incorporates a sleeve 16 which passes through the pontoon 15 to enable inlet and outlet lines 7 and 8 to project into the pontoon 15. This modification enables the product liquid 17 to be withdrawn from the tank 1 once a displacement material, namely water 18, is pumped into the tank 1. As the product liquid 17 is of a specific gravity lower than that of the water 18, the product 17 floats above and on top of, the water 18.

This embodiment is illustrated in more detail in FIG. 5 which shows the sleeve 16 through the pontoon 15 having a cover 19 incorporating a vent hole 20. The inlet/outlet lines 7 and 8, extend above the interface 21 between the liquid product 17 and water 18, thus enabling the liquid product 17 to be fed into and be withdrawn from the tank 1 without the need for the liquid product 17 to pass through the water 18. At the end of each of the inlet/outlet lines 7 and 8 is a vortex breaker 22.

Further incorporated in the tank 1 is a dual gravity drainer 23 which enables the water 18 to be kept at a constant level. The dual gravity drainer 23 is necessary due to the ingress of water falling in the form of rain, or snow which makes its way past the seal 24 and into the tank 1. Also provided in the tank 1 is a gauge glass 25 to enable the exact position of the water interface 21 to be measured for accounting purposes.

It will be appreciated that the layer of water 18 at the bottom of the tank 1 displaces the liquid product 17 from the volume between the base 3 and roof 4 when the roof 4 is at its lowest level. Thus only a tiny heel of liquid product 17 remains in the tank 1.

Figure 6:
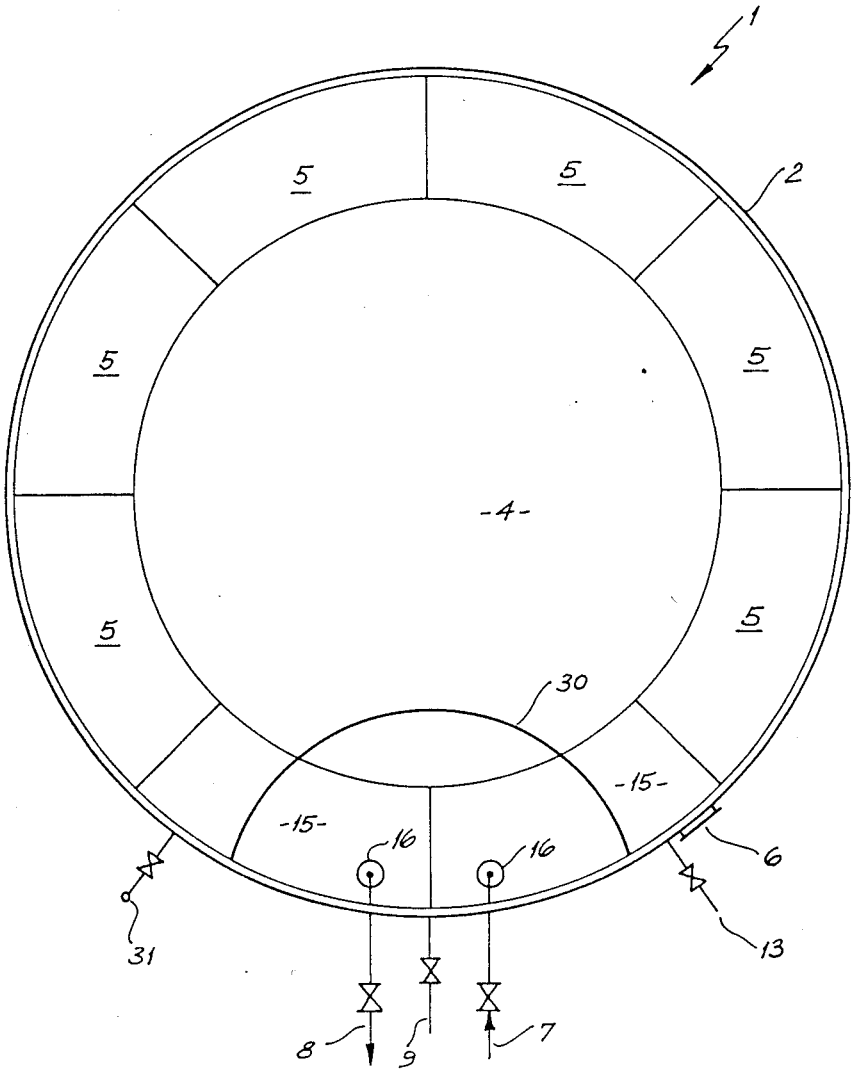
FIG. 6 is a plan view of a floating roof tank of a second embodiment of the present invention.
Figure 7:
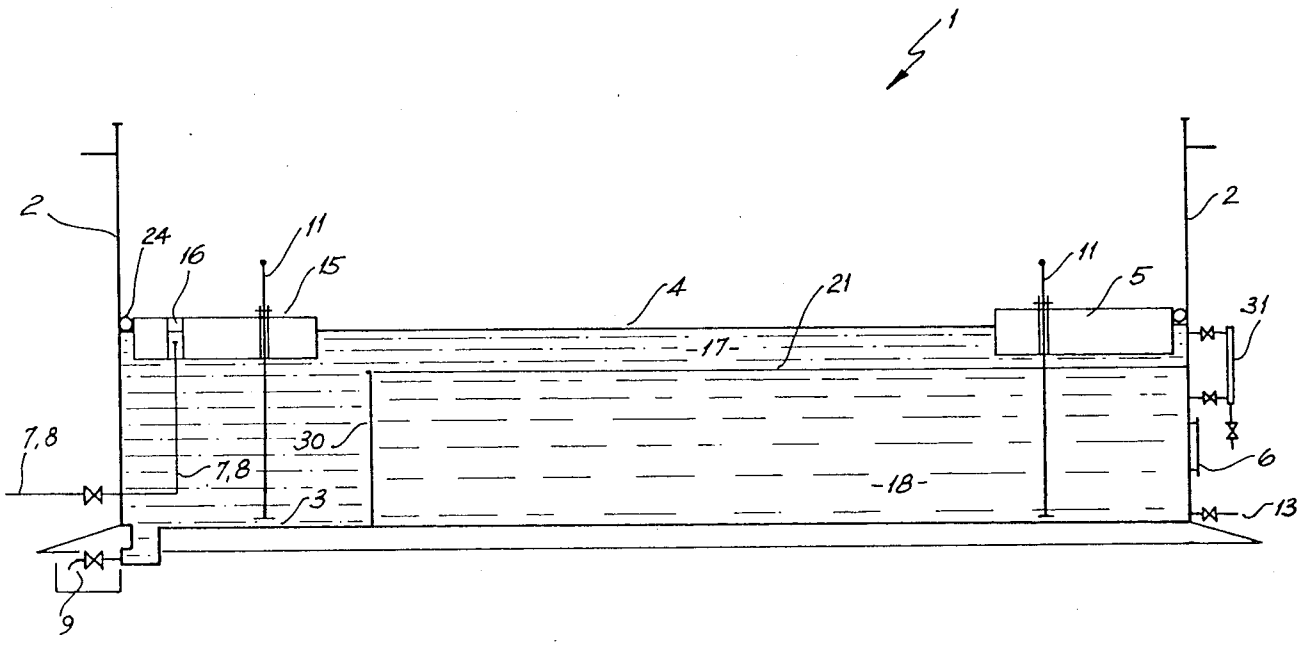
FIG. 7 is a vertical cross-sectional view of the tank of FIG. 6.
Figure 8:
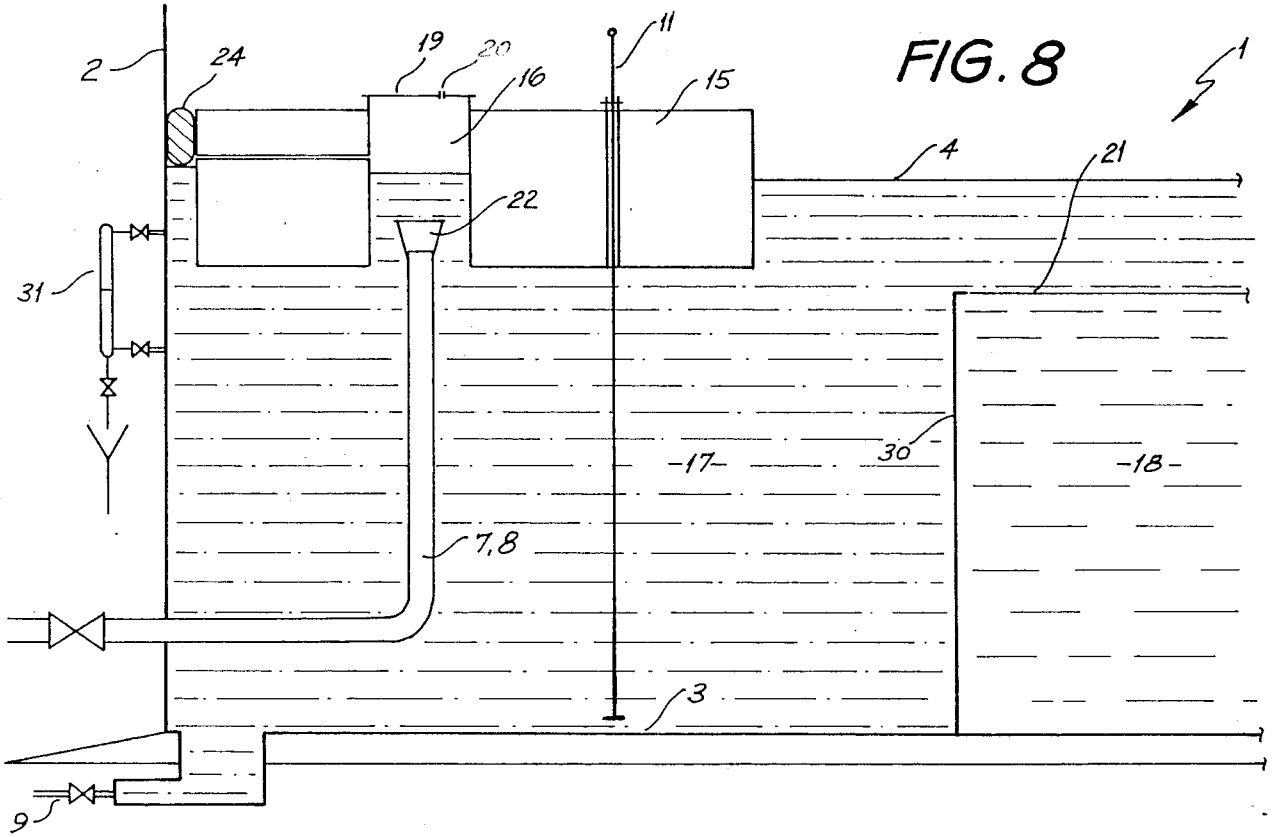
FIG. 8 is a detailed view of a portion of FIG. 7.

In a second embodiment, illustrated in FIGS. 6 to 8, an internal dam wall 30 is provided to impound the water 18. Thus the liquid product 17 is able to be withdrawn from a lower level than the inlet and outlet lines 7 and 8 of FIG. 5. However, it can still be used in conjunction with extended inlet and outlet lines 7 and 8 (as is illustrated in FIG. 8). However, the gauge glass 31 is located in an area of the tank 1 which is not within the product side of the internal dam wall 30. A water fill and drain line 13 is also provided on the water side of the internal dam wall 30.

Figure 9:
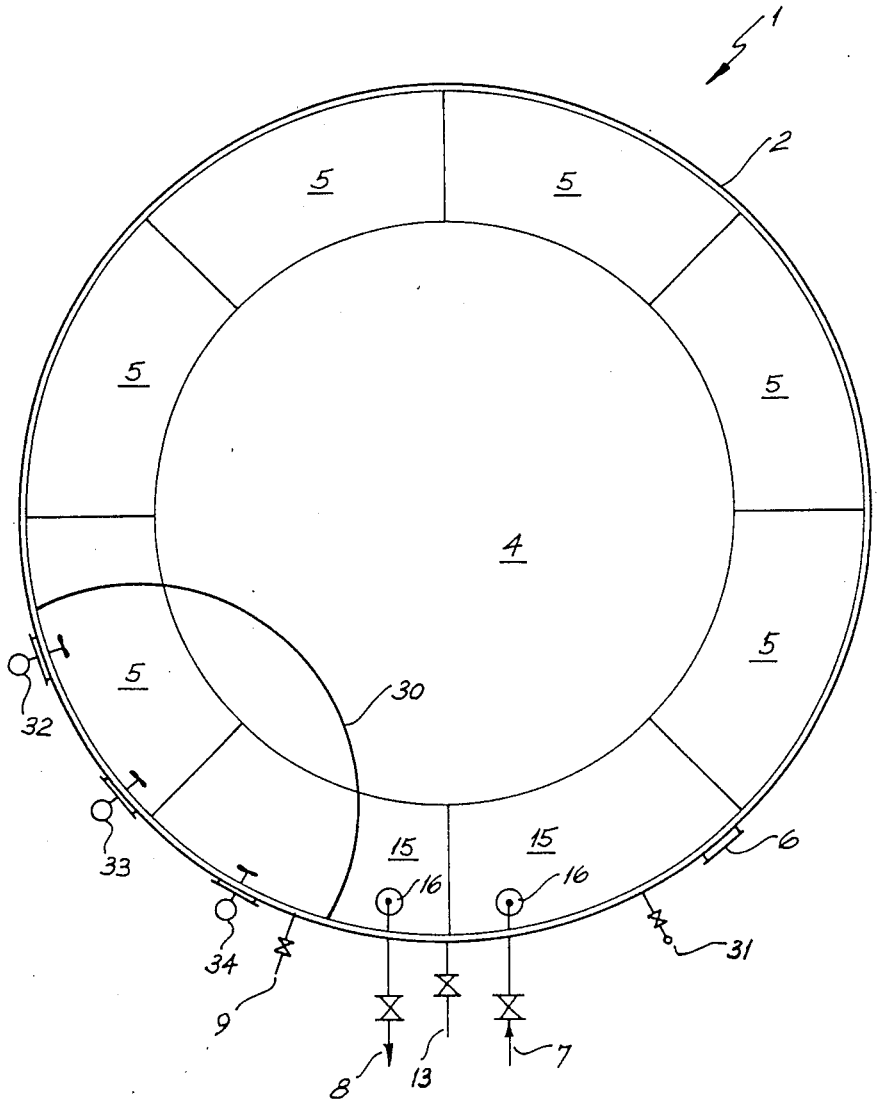
FIG. 9 is a plan view of a floating roof tank of a third embodiment of the present invention.
Figure 10:
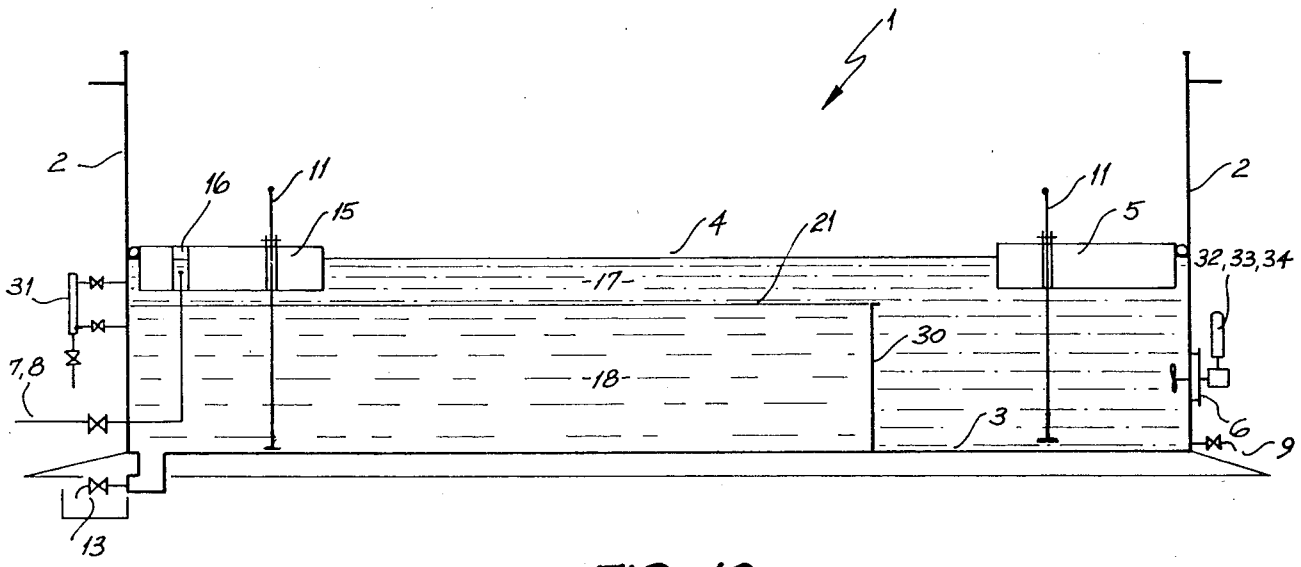
FIG. 10 is a vertical cross-section of the tank of FIG. 9.

Another embodiment is illustrated in FIGS. 9 and 10, and is employed when the tank 1 is used as a mixing tank. Electrical mixers 32, 33 and 34, allow blended gasoline and finished mixed products to be stored in, and/or produced in the tank 1. The internal dam wall 30 is constructed to a height at least just clear of the underside of the roof 4 at minimum gauge. The radius of the internal dam wall 30 is such that the distance from the mixers 32, 33 and 34 to the dam wall 30 will not adversely affect the mixing pattern within the tank 1. A typical radius for the internal dam wall 30 is approximately 10 meters. In conjunction with, or replacing the mixers 32, 33 and 34, can be bayonet heaters or the like. The inlet and outlet lines 7 and 8 for the tank 1 of FIGS. 9 and 10 are as illustrated in FIG. 5 for the tank 1 of FIGS. 3, 4 and 5.

Figure 11:
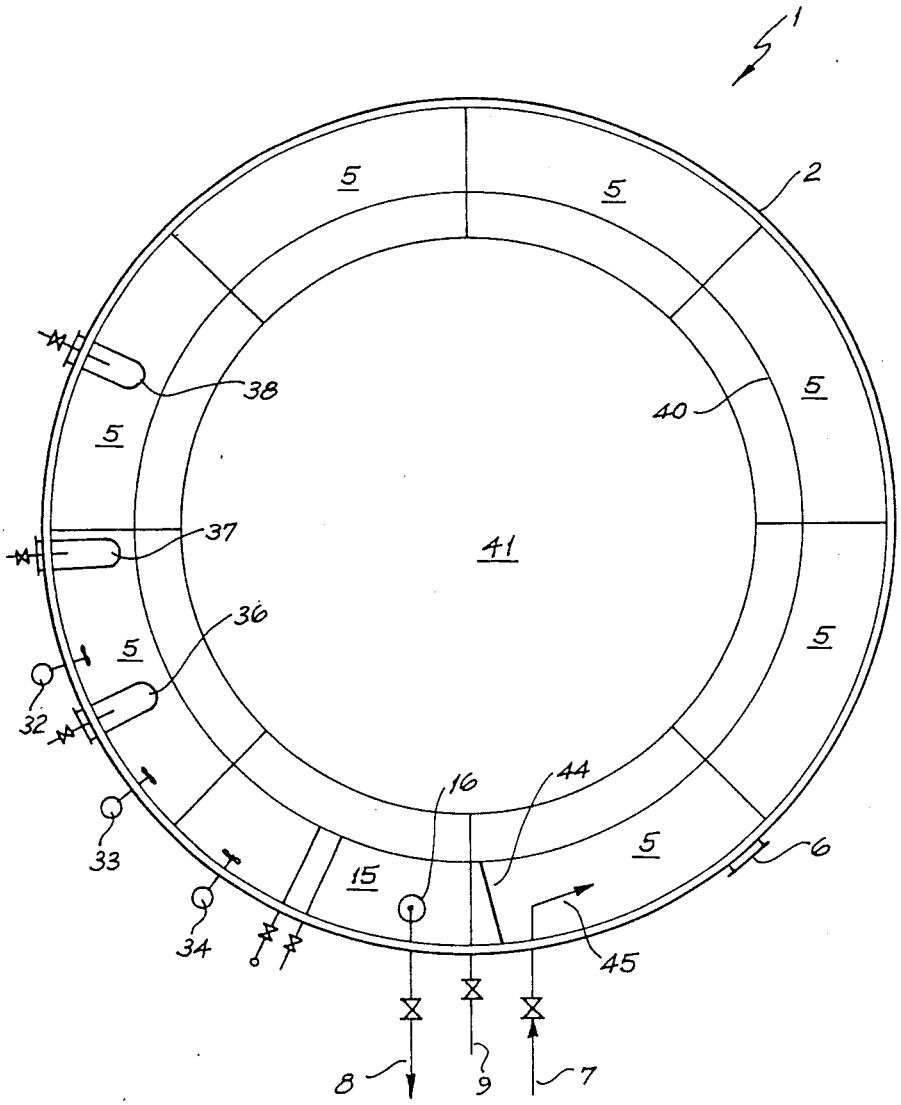
FIG. 11 is a plan view of a floating roof tank of a fourth embodiment of the present invention.
Figure 13:
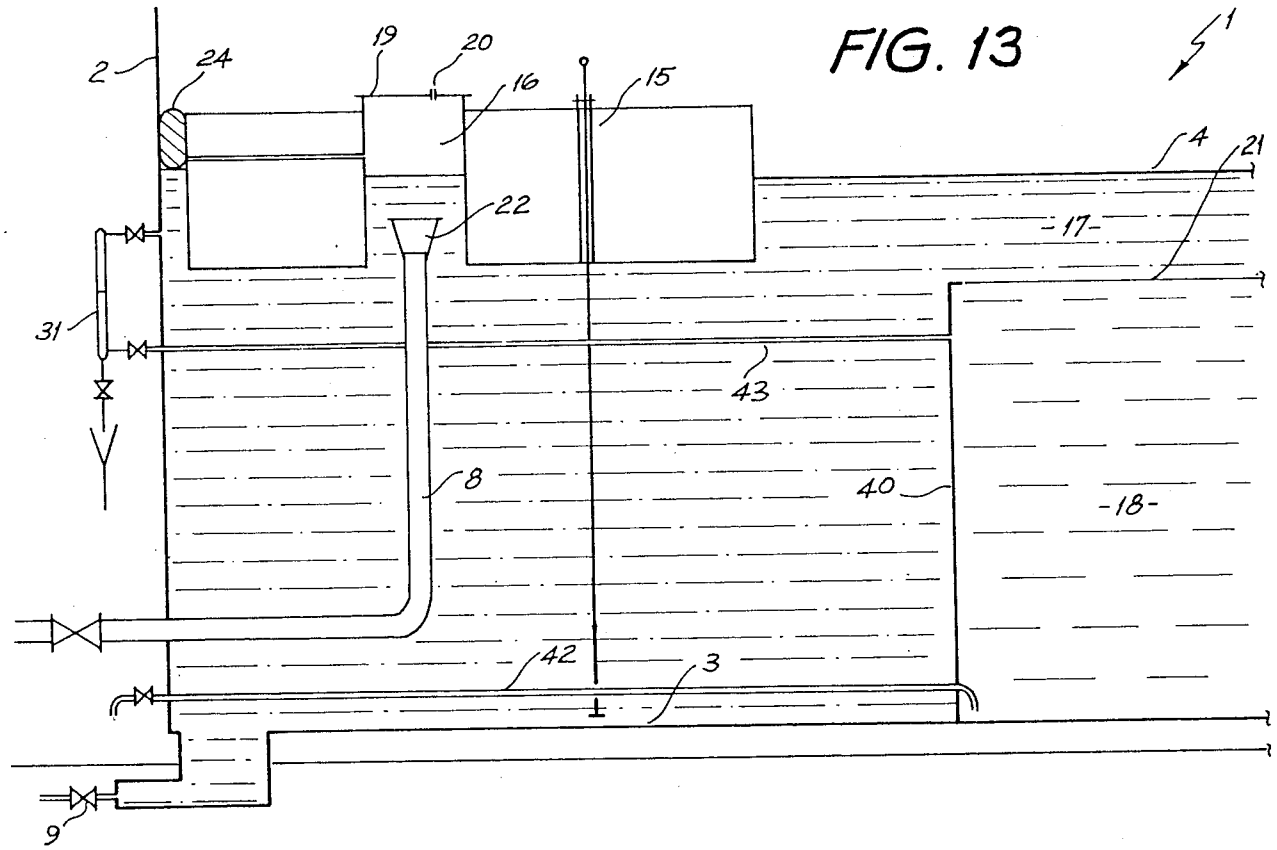
FIG. 13 is a detailed view of a portion of FIG. 12.
Figure 14:
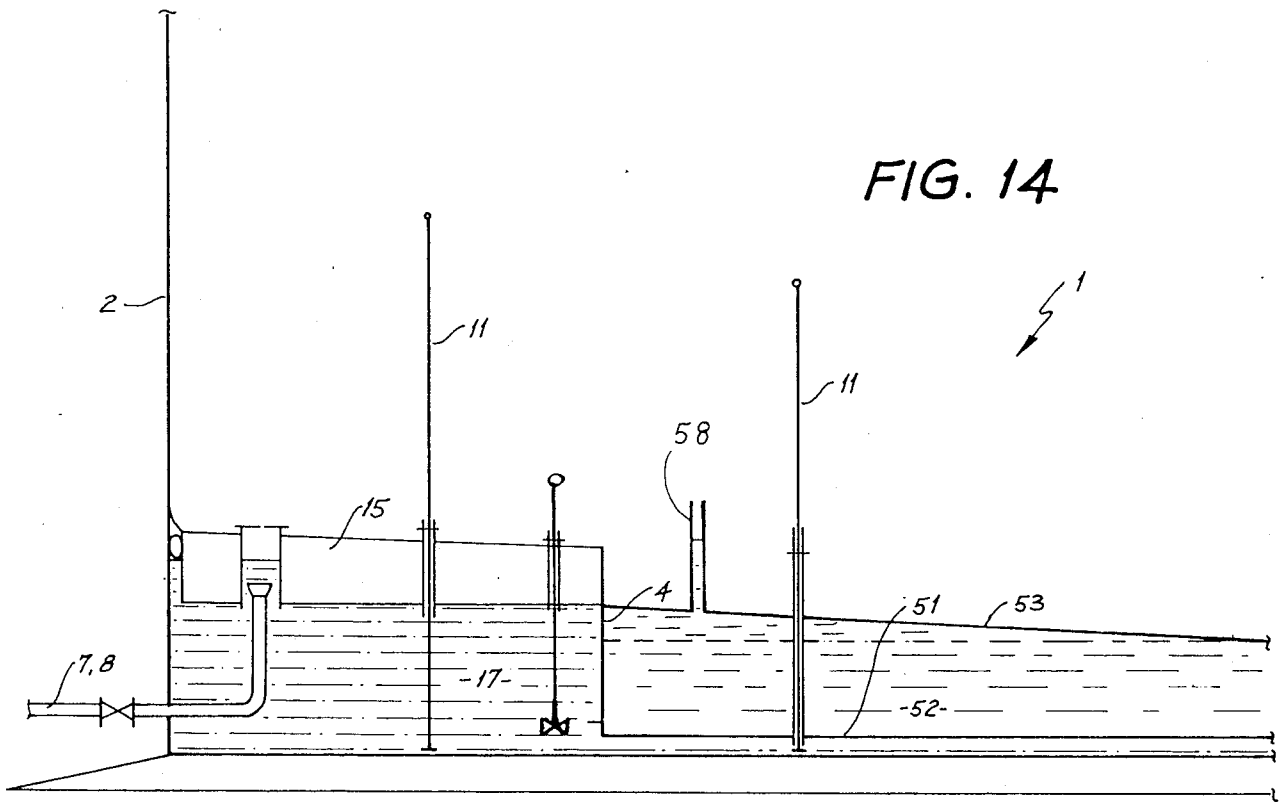
FIG. 14 is a left half vertical cross-sectional view similar to FIG. 13 but of a floating roof tank of a fifth embodiment of the present invention.

In a further embodiment, as illustrated in FIGS. 11, 13 and 14, the tank I is provided with mixers (only three of which 32, 33 and 34 are illustrated) and also with bayonet heaters (again only three of which 36, 37 and 38 are illustrated). The mixers and heaters are located at regular intervals around the circumference of the tank shell 2. In this embodiment a dam wall 40 concentric with the tank shell 2 is provided. Preferably, in order to retrieve as much of the product as possible, the dam wall 40 should be of a diameter which is as large as possible but will clear both the heaters 36 to 38, and the mixers 32 to 33 as well as being located so as to not adversely effect the mixing pattern in the tank 1. It has been found that a typical dimension for the diameter of the dam 40 can be approximately 10 meters less than the diameter of tank shell 2.

As in the other embodiments, water 18 is used and inserted into the dam cavity 41 to enable the displacement of the product 17. As the dam cavity 41 is now no longer sharing a common wall with the tank shell 2, it is necessary to include a separate drain and fill line 42 (as illustrated in FIG. 13) to communicate with the dam cavity 41. Further, it is necessary to have a modified form a gauge glass 31 to enable the respective levels of water 18 and product 17 to be measured. The modified gauge 31 includes a conduit 43 extending through the dam wall 40, to the tank shell 2.

The tank 1, further includes the angled discharge 45 (FIG. 11) on the end of the inlet 7 to enable the liquid product 17 to be discharged around the circumference of the tank shell 2. This enhances mixing and heating of the product 17. However, the creation of a complete whirlpool in the tank 1 is not beneficial to the tank operation, and as such as weir 44, approximately 300 millimeters in height is also included to break up the current produced and aid entrapment of the water contained in the product 17.

Figure 15:
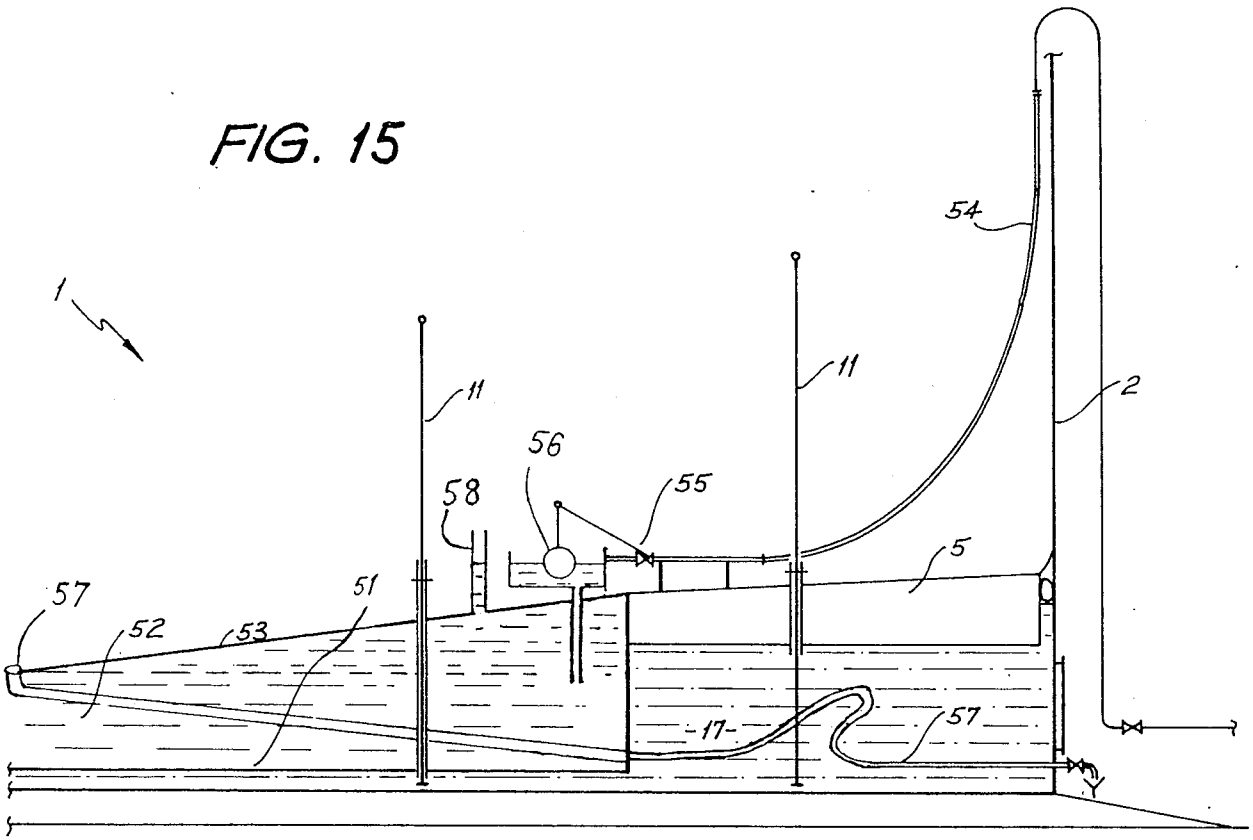
FIG. 15 is a right half vertical cross-sectional showing the right half of the tank of FIG. 14.

Another embodiment is illustrated in FIGS. 14 and 15, which is different from the previous embodiments in that the displacement of the product 17 is achieved by a protrusion extending from the floating tank roof 4. As is illustrated, a downwardly directed container 51 is incorporated within the tank roof 4. The container 51 contains ballast, preferably in the form of water 52. The container has a fully enclosed sloping roof 53 on top. The roof 53 is provided with one or more vents 58 and a centrally located drain 57 including a flexible hose to remove rainwater.

Modifications similar to the previous embodiments are incorporated in the inlet and outlet pipes 7 and 8 and the pontoon 15. In this embodiment, there is a flexible hose 54 (FIG. 15) communicating with the container 51 in order to maintain the amount of water 52 in the container 51. As illustrated, this can be achieved by a float valve 55 which incorporates a ball float 56.

The foregoing described some embodiments of the present invention and modifications obvious to those skilled in the art can be made thereto without departing from the scope of the present invention.

Figure 12:
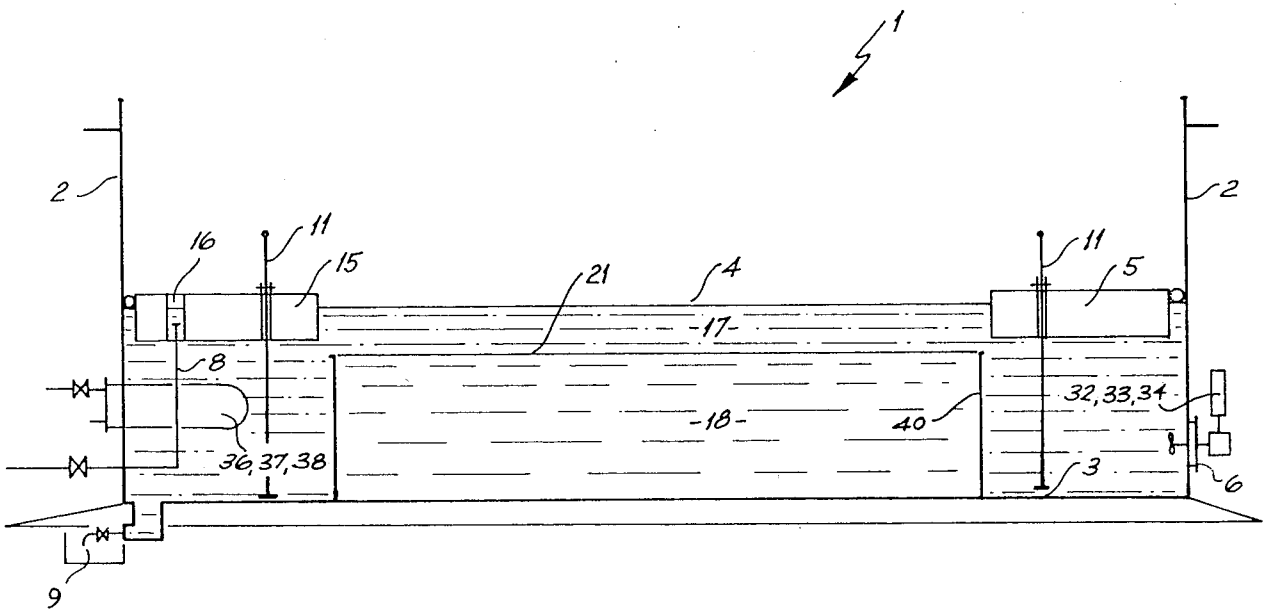
FIG. 12 is a vertical cross-sectional view of the tank of FIG. 11.

For example, in all embodiments, water is chosen as the displacement material due to its relative cheapness and its availability. However, any material having a specific gravity greater than that of the product stored can be used. It is envisaged that new tanks can be designed to incorporate the present invention by providing a displacement volume that consists of, for example, concrete, blue metal etc. and which is built into the base of the tank. Thus the dam 40 and water 18 of FIG. 12, for example, can be replaced by a cylinder of concrete having the same exterior dimensions as the dam 40.

What is claimed as new and desired to be secured by Letters Patent in the United States is:

1. A floating roof liquid storage tank, comprising:

a tank shell supported by a fixed, substantially flat base;

a floating roof buoyantly supported by stored liquid in said tank, said roof including projections extending downwardly therefrom to support said roof at a minimum liquid level in said tank by engagement of lowermost portions of said projections with said base, said projections having a substantially negligible volume relative to the volume of said tank; and displacement means for displacing a major portion of said stored liquid normally present between said base and roof when said roof is at said minimum liquid level, wherein said displacement means comprises (1) a rigid dam wall extending upwardly from said base and having a wall height which extends nearly to but lower than a lowermost surface portion of said roof when said roof is at said minimum liquid level position and (2) a substantially constant volume of a displacement liquid retained on said base by said dam wall, said displacement liquid covering an area less than that of said base of said storage tank and having a substantially constant depth substantilly equal to the height of said dam wall so as to displace said stored liquid and reduce the inventory of said stored liquid that would otherwise remain at emptying of the tank while retaining said displacement liquid behind said dam, said displacement liquid having a specific gravity greater than that of said stored liquid in said tank.

2. A tank as claimed in claim 1 further comprising inlet/outlet conduit means for the liquid supporting the tank roof which passes through said tank shell at a height from said base less than said dam wall height and which are located outside said dam and are immersed in said liquid supporting the tank roof.

3. A tank as claimed in claim 2 wherein said dam wall and said tank shell are each substantially cylindrical with an external diameter of said dam wall being less than an internal diameter of said tank wall.

4. A tank as claimed in claim 3 wherein said dam wall and tank shell are concentric.

5. A tank as claimed in claim 2 wherein said dam wall extends between first and second spaced apart locations on the interior of said tank shell.

6. A tank as claimed in claim 5 wherein said dam wall is substantially arcuate when viewed in plan.

7. A tank as claimed in claim 1 further comprising inlet/outlet conduit means for the liquid supporting the tank roof which are located within said dam, pass through said displacement liquid, and extend above the height of said dam wall.

8. A tank as claimed in claim 7 wherein said floating roof further comprises a pontoon having a sleeve passing substantially vertically therethrough and wherein said inlet/outlet conduit means extends upwardly into said sleeve when said roof is at said minimum liquid level.

9. A tank as claimed in claim 1, further comprising a fill/drain conduit means communicating between the displacement liquid retained by said dam wall and the exterior of said tank.

10. A tank as claimed in claim 1, wherein said tank includes a gauge glass located exterior of said tank and communicating with both the liquid stored in said tank and said displacement liquid to indicate the level of said displacement liquid within said tank.

11. A tank as claimed in claim 10, further comprising a fill/drain conduit means for communication between the displacement liquid retained by said dam wall and the exterior of said tank.

12. A method of displacing an inventory heel of a stored liquid normally located adjacent the base of a floating roof tank that is difficult to withdraw at emptying of the tank, which comprises:

a tank shell supported by a fixed base;

a floating roof buoyantly supported by said stored liquid in said tank, said roof including a plurality of projections extending downwardly therefrom to support said roof at a minimum liquid level in said tank by engagement of lowermost portions of said projection with said base, and said projections having a substantially negligible volume relative to the volume of said tank, and a dam wall extending upwardly from said base; wherein said method comprises the step of displacing a major portion of said stored liquid in said tank normally present between said base and said roof when said roof is at said minimum level by introducing a substantially constant volume of ballast material into said tank adjacent the base thereof, and setting the depth of said ballast material to be less than the height of said roof above said base when said roof is at said minimum liquid level such that said roof is in contact with only said stored liquid when buoyantly supported by said stored liquid in said tank above said minimum liquid level wherein said ballast material comprises a displacement liquid having a specific gravity greater than that of the stored liquid supporting said roof; and restraining said displacement liquid to an area of said tank by retaining said displacement liquid behind said dam wall, said dam wall having a height substantially corresponding to the depths of said displacement liquid so as to displace said stored liquid and thereby reduce the inventory heel of said stored liquid while retaining said displacement liquid behind said dam.

* * * * *